US005927506A

United States Patent [19]

Young et al.

[11] Patent Number: 5,927,506

[45] Date of Patent: Jul. 27, 1999

[54] SUPPORT MEMBER AND BLANK THEREFOR

[75] Inventors: Jack D. Young, Dayton; John D. Troutman, Vandalia; Donald E. Chmiel, Huber Heights, all of Ohio

[73] Assignee: Creative Extruded Products, Inc., Tipp City, Ohio

[21] Appl. No.: 08/936,591

[22] Filed: Sep. 24, 1997

[51] Int. Cl.[6] ..... B65D 81/00

[52] U.S. Cl. ..... 206/756; 206/493; 206/784

[58] Field of Search ..... 206/736, 756, 206/764, 303, 335, 775, 493, 784

[56] References Cited

U.S. PATENT DOCUMENTS

| | | | |
|---|---|---|---|
| 2,565,188 | 8/1951 | Welshenbach . | |
| 2,819,833 | 1/1958 | Sauer . | |
| 3,896,928 | 7/1975 | Forte | 206/784 X |
| 4,119,266 | 10/1978 | Dempster . | |
| 4,134,493 | 1/1979 | Cech | 206/756 |
| 5,624,148 | 4/1997 | Young et al. . | |
| 5,741,115 | 4/1998 | Goglio | 206/493 X |
| 5,845,781 | 12/1998 | Alico et al. | 206/736 |

*Primary Examiner*—Jacob K. Ackun
*Attorney, Agent, or Firm*—Reuben Wolk

[57] ABSTRACT

A support member formed from a single piece blank of cardboard or similar material which is creased or scored to enable it to be formed into the member having a generally boat-shaped configuration. Parallel sides extend vertically and have curved ends at the forward and aft surfaces. A primary member is hingedly secured to the sides to form a bottom and is secured to the curved ends of the side members to form curved planar surfaces which then extend inwardly to form supporting arrises, these members thus forming a hollow opening in the interior of the member. Products such as elastomeric automotive window moldings are supported on the arrises, droop inwardly into the openings, and pass under the bottom. Legs formed on lower surfaces of the sides raise the bottom member. The assembled support member and moldings may be used as a work station on the automotive assembly line.

25 Claims, 2 Drawing Sheets

SUPPORT MEMBER AND BLANK THEREFOR

BACKGROUND OF THE INVENTION

The present invention relates to a support member, particularly designed for supporting long lengths of products such as elastomeric automotive window trim moldings. The support member is formed from a single sheet of material such as cardboard, suitably creased or scored to facilitate formation into a shape adapted to preserve the structural integrity of the molding.

PRIOR ART STATEMENT

It is well known in the field of packaging to utilize a single cardboard or paperboard blank which is creased or scored to permit it to be folded into a desired finished packaging member, usually including slots and flaps for interlocking the various parts of the blank. Such members are shown, for example in Welshenbach U.S. Pat. No. 2,565,188; Sauer U.S. Pat. No. 2,819,833; and Dempster U.S. Pat. No. 4,119, 266. The same principle is utilized in forming the support member of the present invention, which is not a packaging member, but rather is utilized for supporting work products that are to placed within a shipping container.

SUMMARY OF THE INVENTION

The support member of the present invention is formed from a single cardboard or paperboard blank which is creased or scored to enable it to be formed into its finished configuration. The finished member has a generally boat-shaped configuration with identical vertical opposite parallel sides. Hingedly interconnected to the sides is a principal body member whose interconnected portion forms the bottom of the support. The sides have straight upper edges and curved edges on both the forward and aft ends thereof which extend beyond the hinged interconnection. The principal body member has portions extending beyond the interconnected bottom and continues upward and is secured to these curved edges to form planar surfaces, then these planar surfaces extend downwardly at an angle to the upper edges and are attached thereto. The downwardly extending portions form arrises for supporting certain critical portions of the product placed thereon. The support member is primarily designed to support a plurality of long lengths of flexible elastomeric window trim molding for automotive windows, such as windshields or rear windows. A typical molding is shown, for example, in U.S. Pat. No. 5,624,148, issued to Young et. al. the sides and principal body portion cooperate to create an open area so that the portions of the molding between the supporting arrises are allowed to droop into these open area without touching the bottom surface of the support member to minimize crushing the product. Legs are formed on the sides to raise the bottom from the ground or any outer carton into which the support member may be placed.

The assembled support member and plurality of moldings placed thereon create a dual purpose assembly; not only are the products supported during shipping, but upon reaching the destination at the automotive installation area, it becomes a work station as well. The support is lifted from the outer shipping carton and placed adjacent the assembly station so that the installer may remove each molding for assembly.

It is therefore a principal object of the invention to provide a support member made from a single piece blank.

It is a further object to provide a member which supports long length resilient products in a manner preserving the structural integrity of the products.

It is a further object to utilize the support member bearing its products, as a work station.

These and other objects and features will be apparent from the embodiment described and shown herein.

DESCRIPTION OF THE PREFERRED EMBODIMENT

Figure 1:
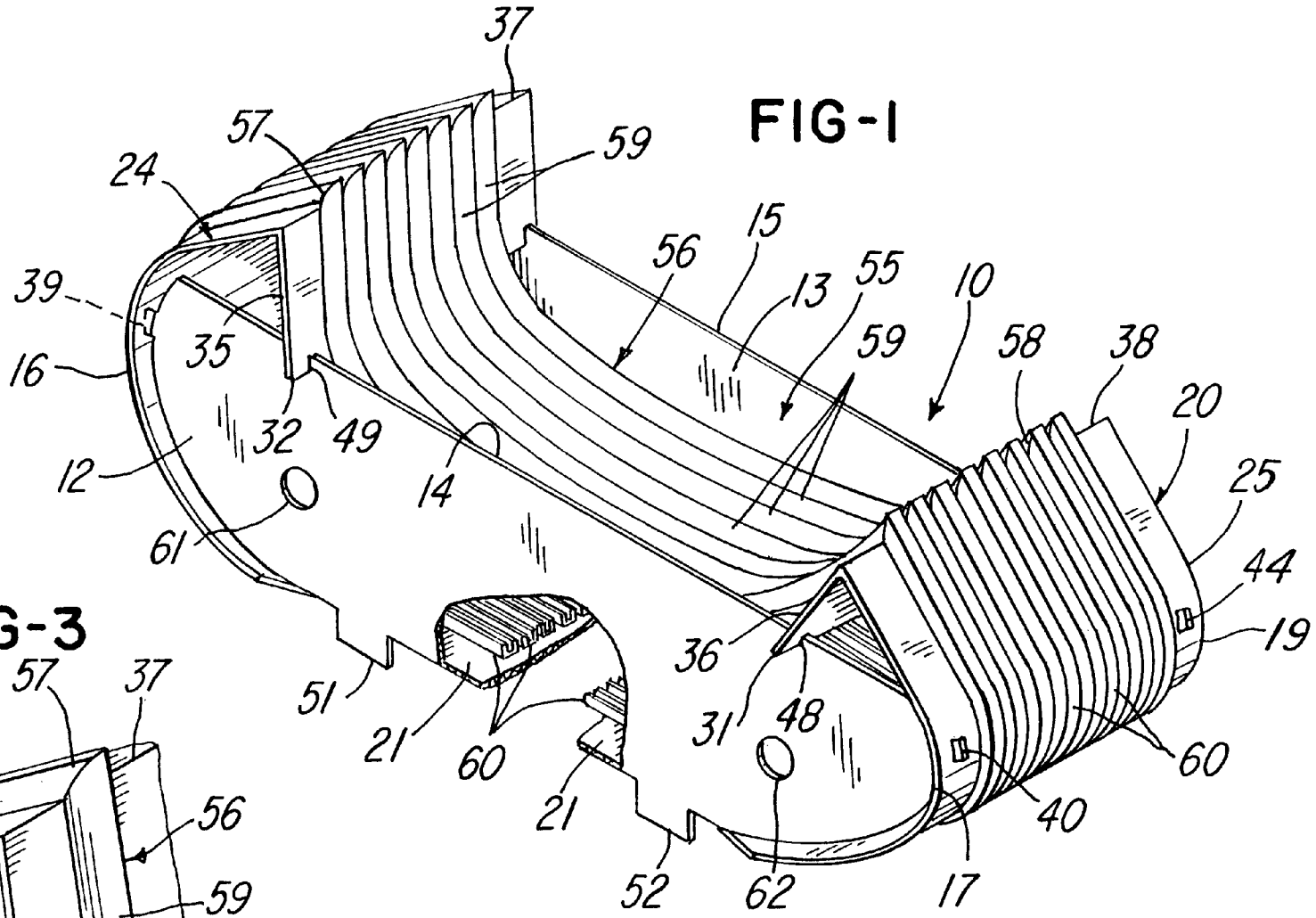
FIG. 1 is a perspective view of the novel support member with the supported products shown thereon, having portions broken away for clarity.
Figure 2:
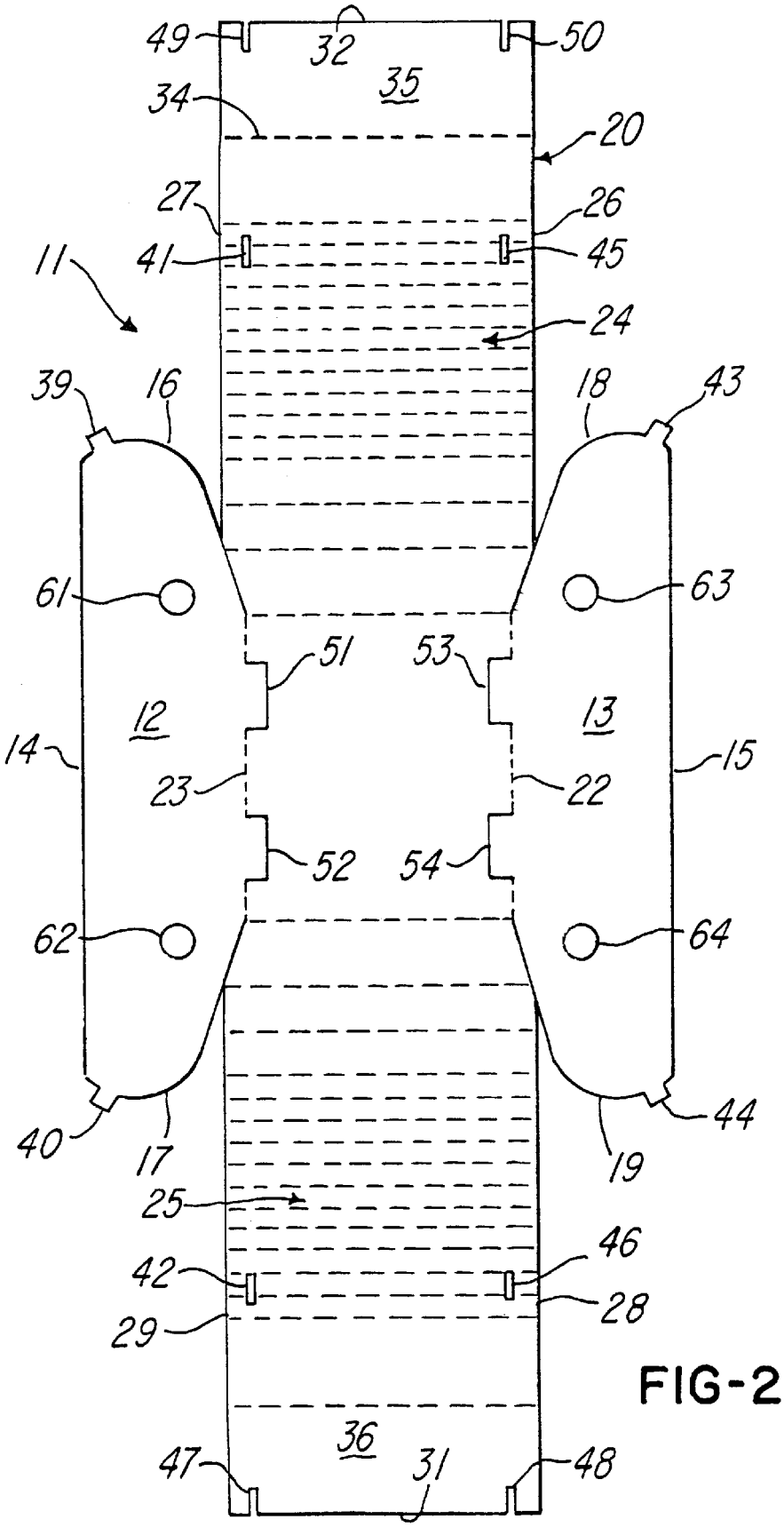
FIG. 2 is a plan view of a one-piece blank which is formed into the support member of FIG. 1.

Referring to the drawings, FIG. 1 illustrates a novel support member designated by reference number 10. This is formed by manually folding a one-piece pre-scored or pre-creased blank 11 shown in FIG. 2. The blank consists of two equal sides 12 and 13 having straight edges 14 and 15 and opposite curved edges 16, 17, 18 and 19. A principal member 20 has a portion 21 hingedly attached to both sides along score or crease lines 22 and 23 but the remainder of the principal member has portions 24 and 25 whose sides 26, 27, 28 and 29 are free of attachment and extend in a direction longitudinal of the sides and extend to their edges 14 and 15. A series of score or crease lines designated by reference number 30 extend laterally of the principal member from side 26 to side 27 and from side 28 to side 29, allowing the principal member 20 to be formed as indicated below. The principal member terminates at ends 31 and 32, and closely adjacent to these ends are additional crease or score lines 33 and 34. Additional flaps and slots are provided on the blank for purposes to be described below.

In order to form the support member 10 into its desired configuration of FIG. 1, the sides 12 and 13 are erected to a vertical position by folding them along the lines 22 and 23 so that they are perpendicular to the bottom 21 of the principal member 20, the straight edges 14 and 15 now being the top edges of the sides. The free-standing portions 24 and 25 are now folded upward, using the score lines 30, so they are in contact with the curved edges of the sides and thus form curved planar surfaces; the formation of the planar surfaces being facilitated by these score lines. The end segments of the portions 24 and 25, which are designated by reference numbers 35 and 36, are folded inwardly over the score lines 33 and 34 at an angle between 45 and 90 degrees, depending on the specific product to be supported, as described below. These planar surfaces cooperate with the surfaces 35 and 36 to create support arrises 37 and 38 for the purpose to be described. The entire assembly is locked into place by inserting flaps 39 and 40 of side 12 into slots 41 and 42 on one side of the portions 24 and 25; and flaps 43 and 44 of side 13 into slots 45 and 46 on the other side of these portions. To complete the locking procedure, slots 47 and 48 at the end 31, and slots 49 and 50 at the end 32, are placed over the upper straight edges 14 and 15 of the sides. Additional support may be provided by additional flaps and slots if necessary. The support member usually supports approximately 15 to 20 moldings. The resulting assembled support member has a generally boat-shaped configuration formed by the sides, bottom, and curved planar surfaces, all cooperating to form the hollow opening 55 within the support member.

An additional feature of the invention is the formation of supporting feet which extend below the bottom 21, thus allowing the bottom to clear the ground or to clear the bottom surface of an outer shipping carton into which the supporting member may be placed, This is accomplished by forming cutout portions 51 and 52 in the side 12, and cutout portions 53 and 54 in the side 13. These portions are bent into a vertical direction, on the same plane as the vertical sides so that they form the supporting feet. The portion of the moldings passing under the bottom thus avoids being crushed.

Figure 3:
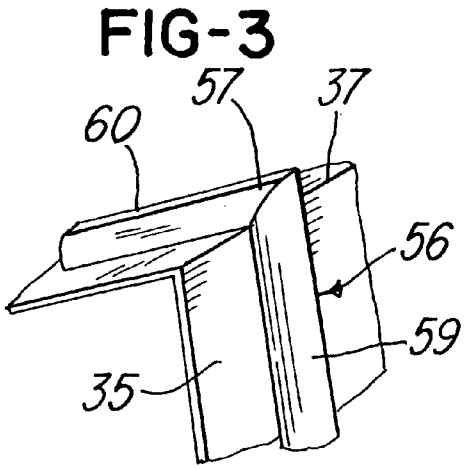
FIG. 3 is an enlarged detail view illustrating a critical portion of the product placed on its supporting arris.

The finished support member is now utilized by placing thereon the products being shipped. As referred to above, the preferred products are flexible elastomeric long length automotive window moldings, designated by reference number 56, also referred to in the trade as "reveal moldings" or "header lace", usually about 8 to 9 feet in length. These moldings are frequently formed with welded joints, shown in FIGS. 1 and 3 and designated by reference numbers 57 and 58; the use of these welds achieves an improved fit at the corners of the windows to which they are fitted. As shown in the drawings, the joints are placed on the arrises 37 and 38 to provide extra support and minimize the danger of pulling them apart because of the stresses imposed by the great weight of the molding, The upper portion of the moldings is designated by reference number 58, which extends between the welded joints, and is allowed to droop into the opening 55 but does not contact the upper surface of the bottom 21. The lower portion of the moldings, reference number 60, passes around the curved surfaces 24 and 25 and under the lower surface of bottom 21, but does not touch the surface beneath the bottom because of the elevation provided by legs 22 and 23. The support member and moldings may, if desired, be lifted for placement in the outer carton, or for other purposes, by using the holes 61, 62, 63 and 64 in the sides. It is important that the structural integrity of the moldings be preserved during shipping, so that the moldings will meet the required tolerances between the window and the frame required by the manufacturer of the vehicle. It is also important to prevent marring or deformation of the molding. By carefully placing the welded joints 57 and 58 over the arrises 37 and 38, as shown in FIG. 3, the stress on the joints is much less than if the joints were haphazardly placed. The angle of the molding at the weld matches the angle of the arris so that the planar surface adjoining the arris provides maximum support. Since this weld is at the corner of the window, it is usually in the range of 45 to 90 degrees, preferably about 75 degrees.

An additional advantage of the novel support member resides in its dual use. As indicated above, the assembled moldings and support member are normally placed in a conventional shipping container and delivered to the customer, such as an auto manufacturer, who will install the moldings on the appropriate window, such as the windshield, the rear window, or side windows. The assembly is delivered to the appropriate area of the assembly line, where it becomes a self-sufficient work station. The installer can conveniently remove each piece of molding from the support member for installation on the auto he is working on. For added convenience, the assembly line worker may elevate the support member if it fits his level. This may be done by inserting a rod (not shown) through opposing holes 61 and 63 in the sides of the support member; and a similar rod through holes 62 and 64, and placing the rods on an elevated work rack.

The embodiment shown herein is exemplary, and modifications are contemplated within the spirit of the invention.

We claim:

1. A support member having a generally boat-shaped configuration comprising opposite parallel vertical sides having top and end edges, a principal member having a first segment hingedly connected to said sides to form a bottom wall, said principal member having additional segments free of connection to said sides and extending upwardly around and secured to said end edges of said walls to form planar surfaces therebetween, said planar surfaces having end segments extending downwardly at an angle to form supporting arrises therein.

2. The support member of claim 1 wherein said end segments of said principal member are defined by score lines extending transversely thereof, said supporting arrises being formed by bending said segments at said score lines.

3. The support member of claim 1 wherein said end edges of said sides are curved and said additional segments of said principal member form curved planar surfaces.

4. The support member of claim 3 wherein said additional segments have a plurality of score lines extending transversely thereof for forming said planar surfaces.

5. The support member of claim 1 wherein said side members and said principal member cooperate to form a hollow opening.

6. The support member of claim 1 wherein said arrises form an angle of between 45 and 90 degrees.

7. The support member of claim 1 further comprising supporting legs adjacent said bottom wall for elevating said bottom wall.

8. The support member of claim 7 wherein said legs are formed from a portion of said sides adjacent said hingedly connected first segment of said principal member.

9. The support member of claim 1 further comprising a plurality of holes in said sides for lifting said support member.

10. The support member of claim 1 further comprising means for interlocking said sides with said principal member.

11. The support member of claim 10 wherein said interlocking means include means for interlocking said end segments of said planar surfaces to said top edges of said sides.

12. The support member of claim 10 wherein said interlocking means include means for interlocking said sides with said additional segments of said principal member.

13. An integral one piece blank adapted to be formed into a support member, said blank comprising a pair of side walls having outer edges and opposed inner edges, a principal member having a portion hingedly attached at score lines to said side walls to form a bottom wall, said principal member having free portions extending longitudinally of said side walls beyond said hingedly connected portion, said free portions having a first set of transverse score lines to enable said free portions to be bent into a shape adapted to fit along said inner edges of said side walls, said free portions having end segments defined by a second set of score lines enabling said end segments to be bent downwardly at an angle to be formed into supporting arrises.

14. The blank of claim 13 wherein said inner edges of said side walls are curved inwardly toward said principal member.

15. The blank of claim 14 wherein said first set of transverse score lines enables said free portions to be bent into a curved shape to fit said curved inner edges of said side walls.

16. The blank of claim 13 wherein said end segments of said principal member include locking means adapted to interlock with said outer edges of said side walls.

17. The blank of claim 13 wherein said side walls include locking means adapted to interlock with said free portions of said principal member.

18. In combination, a support member and a plurality of elastomeric automotive moldings mounted thereon for use as a loading and work station, said support member having a generally boat-shaped configuration comprising opposite parallel vertical sides with top and end edges, a principal member hingedly connected to said sides to form a bottom wall, said principal member having additional segments free of connection to said sides and extending upwardly around and secured to said end edges of said side walls to form planar surfaces therebetween, said planar surfaces having end segments extending downwardly at an angle to form supporting arrises for supporting selected portions of said molding strips.

19. The support member of claim 18 wherein said end edges of said sides are curved and said additional segments of said principal member form curved planar surfaces.

20. The support member of claim 18 wherein said arrises form an angle of between 45 and 90 degrees, and said selected portions of said moldings have a corresponding angle for placement on said arrises.

21. The support member of claim 18 wherein said sides and said principal member form a hollow opening in said support member, said moldings having upper portions of extending between said supporting arrises and into said opening.

22. The support member of claim 21 wherein said upper portions of said moldings are free of contact with said bottom wall.

23. The support member of claim 18 wherein said support member has supporting legs for elevating said bottom above a ground surface.

24. The support member of claim 23 wherein said moldings have lower portions extending between said supporting arrises and under said bottom wall free of contact with said ground surface.

25. The support member of claim 18 wherein said support member has a plurality of holes in said sides for lifting said combination.

* * * * *